US005774775A

United States Patent [19]

Aoto et al.

[11] Patent Number: 5,774,775

[45] Date of Patent: Jun. 30, 1998

[54] ELECTROPHOTOGRAHIC IMAGE FORMING METHOD USING AN INTERMEDIATE IMAGE TRANSFER ELEMENT

[75] Inventors: Jun Aoto, Fuji; Yasuo Hirano; Masahide Yamashita, both of Numazu; Mitsuru Seto, Kanagawa-ken; Shigeru Fukuda, Kawasaki, all of Japan

[73] Assignee: Ricoh Company, Ltd., Tokyo, Japan

[21] Appl. No.: 622,590

[22] Filed: Mar. 26, 1996

[30] Foreign Application Priority Data

Mar. 31, 1995 [JP] Japan ..... 7-076743
Dec. 22, 1995 [JP] Japan ..... 7-335560

[51] Int. Cl.[6] ..... G03G 15/16

[52] U.S. Cl. ..... 399/308

[58] Field of Search ..... 399/297, 298, 399/299, 302, 308

[56] References Cited

U.S. PATENT DOCUMENTS 5,243,392 9/1993 Berkes et al. ..... 399/308
5,340,679 8/1994 Badesha et al. ..... 399/297 X
5,530,532 6/1996 Iino et al. ..... 399/308 X
5,531,101 7/1996 Nozawa et al. ..... 399/297 X

FOREIGN PATENT DOCUMENTS 3-168784 7/1991 Japan .
6-095413 4/1994 Japan .
6-250413 9/1994 Japan .
7-152262 6/1995 Japan .

*Primary Examiner*—Fred L. Braun
*Attorney, Agent, or Firm*—Oblon, Spivak, McClelland, Maier & Neustadt, P.C.

[57] ABSTRACT

An image forming method wherein a toner image on an image carrier is transferred in a first transfer step to an intermediate image transfer element, the transferred toner image on said intermediate image transfer element being subsequently transferred in a second transfer step to a transfer medium. The intermediate image transfer element has a surface whose angle of contact with water is at least 70 degrees and whose position in the triboelectric series is on a positive side with respect to the position of said toner when the toner on the image carrier is negatively charged and on a negative side with respect to the position of the toner when the toner on the image carrier is positively charged.

13 Claims, 2 Drawing Sheets

ELECTROPHOTOGRAHIC IMAGE FORMING METHOD USING AN INTERMEDIATE IMAGE TRANSFER ELEMENT

BACKGROUND OF THE INVENTION

This invention relates generally to an electrophotographic image forming method used in, for example, copiers, printers or facsimile machines and, more specifically, to an image forming method wherein a toner image on an image carrier is transferred in a first transfer step to an intermediate image transfer element, the transferred toner image on the intermediate image transfer element being subsequently transferred in a second transfer step to a transfer medium such as paper.

In the image forming method using an intermediate image transfer element, it is important that the toner image should be transferred from the intermediate image transfer element to the transfer medium with a high efficiency, e.g. at least 90%, in order to obtain a clear image free of local omission (so called "worm-eaten" portions) of toner images. To meet with this requirement, a number of methods have thus far been proposed. JP-A-58-187968 discloses a method in which an organic fluorine compound is fed to a surface of an intermediate image transfer element, JP-A-2-198476 proposes a method in which a wettability controlling agent is incorporated into an intermediate image transfer element, JPA-2-213881 proposes a method in which a protecting layer of a lubricant such as zinc stearate is formed over an intermediate image transfer element, JP-A-4-305666 proposes polishing the surface of an intermediate image transfer element during use and JP-A-5-210315 proposes a method in which a toner image on an intermediate image transfer element is subjected to a corona discharge treatment to control the amount of electrification of the toner image. The known methods, however, are not fully satisfactory.

SUMMARY OF THE INVENTION

In accordance with the present invention there is provided an image forming method wherein a toner image on an image carrier is transferred in a first transfer step to an intermediate image transfer element, the transferred toner image on the intermediate image transfer element being subsequently transferred in a second transfer step to a transfer medium. The intermediate image transfer element has a surface whose angle of contact with water is at least 70 degrees and whose position in the triboelectric series is on a positive side with respect to the position of the toner when the toner on the image carrier is negatively charged and on a negative side with respect to the position of the toner when the toner on the image carrier is positively charged.

It is the prime object of the present invention to provide an image forming method using an intermediate image transfer element, which can give toner images free of "wormeaten" portions.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
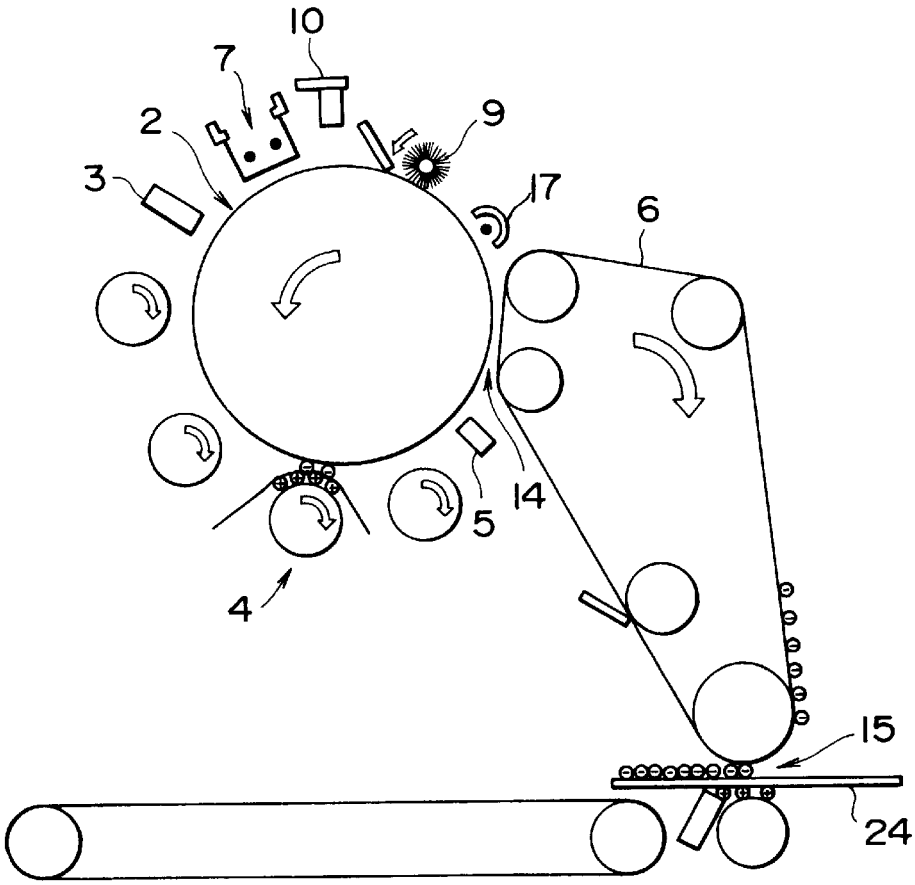
FIG. 1 is a vertical cross-sectional view diagrammatically showing the general construction of a color image forming apparatus suitable for carrying out the method of the present invention.

FIG. 1 depicts an image forming apparatus which is suitably used for carrying out the method according to the present invention and which is known per se. Designated as 13 is a drum or a charge carrier rotated about the axis thereof and adapted to carry a toner image thereon. Arranged around the circumference of the drum 13 are drum cleaning means 17 and 9, a discharge lamp 10, a charger 7, an exposing section 2, a potential sensor 3, a developing device 4 including four units for cyan, magenta, yellow and black colors, a sensor 5 and a primary image transfer section 14 where an intermediate image transfer element 6 in the form of an endless belt is in moving contact with the drum 13. The intermediate image transfer element 6 moves along a predetermined path including a secondary image transfer section 15 where an image transfer medium 24 such as paper is fed for contact with the image transfer element 6.

In operation, the drum 13 is electrified either positively or negatively by the charger 7 and imagewise exposed in the exposing section 2 to form a latent image. The latent image on the drum 13 is then developed by the developing device 4 to form a toner image with a first color such as cyan, which in turn is transferred in the primary transfer section 14 to the intermediate image transfer element 6. Similar operations are repeated for successively transferring toner images of different colors to the intermediate image transfer element 6, thereby obtaining a full color toner image thereon. The full color toner image on the element 6 is then transferred in the secondary image transfer section 15 to the image transfer medium 24 and is fixed in a fixing section (not shown) to obtain a full color copy.

It has been found that not only the surface smoothness of the intermediate image transfer element 6 but also the compatibility between the toner and the intermediate image transfer element 6 has a great influence upon the image transferability of the toner image on the intermediate image transfer element 6 to the image transfer medium 24. Thus, it is important that the surface of the intermediate image transfer element 6 on which toner images are formed should have an angle of contact with water of at least 70 degrees, in order to obtain satisfactory image transferability. The contact angle with water is preferably 80–120 degrees.

Additionally, the triboelectric characteristic of the intermediate image transfer element 6 relative to the toner has been found to play an important role in the image transfer of the toner image on the intermediate image transfer element 6 to the image transfer medium 24. Thus, it is important that the position in the triboelectricity series of the surface of the intermediate image transfer element 6 should be on a positive side with respect to the position of the toner when the toner on the image carrier 13 is negatively charged and on a negative side with respect to the position of the toner when the toner on the image carrier 13 is positively charged.

The triboelectric series is a sequence of substances so arranged that any one of them is positively electrified by rubbing it with any other substance further on in the list. Thus, the surface of the intermediate image transfer element 6 used in the present invention is (a) positively electrified upon being rubbed with a toner when the toner is of a type which is negatively charged in the developing step and (b) negatively electrified upon being rubbed with a toner when the toner is of a type which is positively charged in the developing step.

Presumably, the formation of "worm-eaten" portions in the conventional image forming methods is caused as follows.

As shown in FIG. 2(*a*), toner particles 22 on the intermediate charge transfer element 6 just after the primary charge transfer step are uniformly charged in one polarity, i.e. negatively in the illustrated case. When the toner image-bearing element 6 is subjected to shearing forces such as by pressurization and friction in the secondary charge transfer step, part of the toner particles 23 are positively electrified, as shown in FIG. 2(*b*), upon the frictional contact of the toner particles with the surface of the element 6 in a case where the surface of the element 6 is positioned in the triboelectric series on a negative side with respect to the position of the toner.

As a consequence, when an electrical field E is applied between the image transfer medium 24 and the element 6, the positively charged toner particles 23 are not transferred to the medium 24, as shown in FIG. 2(*c*). Further, a part of the negatively charged toner particles 22 are bound by the positively charge toner particles 23 to form an untransferred portion 25, so that a "worm-eaten" portion 28 is formed on the image transfer medium 24.

In the present invention, since the surface of the intermediate image transfer element 6 is on a positive side with respect to the position of the toner when the toner on the image carrier 13 is negatively charged (and on a negative side with respect to the position of the toner when the toner on the image carrier 13 is positively charged), the image transfer can be smoothly effected without causing the formation of "worm-eaten" portions.

It is preferred that the electrification of the toner is −40 to 0 $\mu$C/g, more preferably −30 to 0 $\mu$C/g when the toner on the image carrier 13 is negatively charged and 0 to 40 $\mu$C/g, more preferably 0 to 30 $\mu$C/g when the toner on the image carrier 13 is positively charged.

Figure 3:
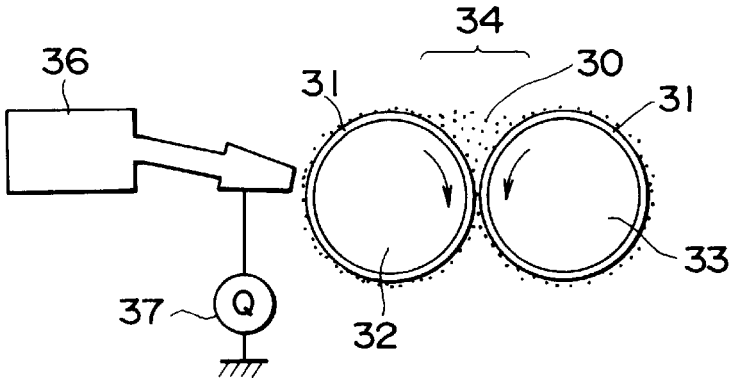
FIG. 3 is a vertical cross-sectional view diagrammatically showing a device for measuring the amount of charge formed on toner by triboelectricity.
Figure 2A:
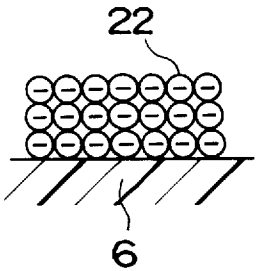
FIGS. 2(*a*) through 2(*d*) are schematic illustration explanatory of charge transfer from an intermediate image transfer element to a transfer medium.
Figure 2B:
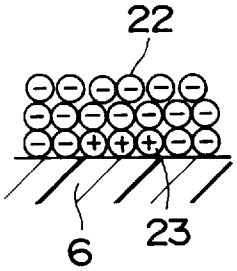
Figure 2C:
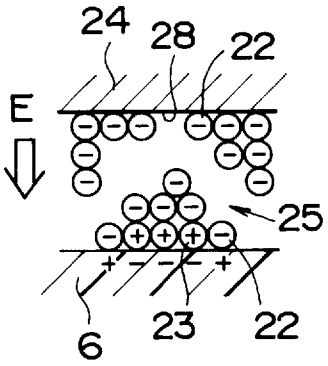
Figure 2D:
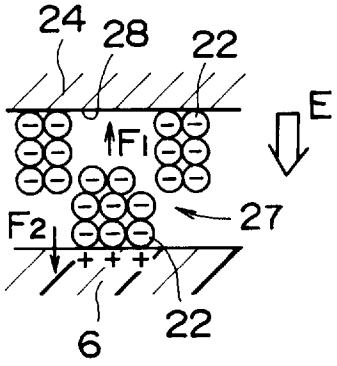

The term "electrification of toner" used herein is intended to refer to an amount of charge obtained by the following measuring method:

As schematically illustrated in FIG. 3, a pair of rollers 32 and 33 each made of stainless steel and having a diameter of 100 mm are each covered with a layer 31 which is made of the same material as used in the intermediate image transfer element 6. The thickness of the layer 31 is 100 $\mu$m. The rollers 32 and 33 are horizontally disposed in parallel with each other to define a gap of 20 $\mu$m between respective surface layers 31. After sample toner 30 (5 g) has been placed on an upper region of the two rollers 32 and 33, the rollers are rotated for 60 seconds in opposite directions as indicated by the arrows at linear speeds of 100 mm/sec and 105 mm/sec, respectively. Then, the toner deposits on the surfaces 31 of the rollers 32 and 33 are collected by a vacuum pump 36. The total charge CT of the thus collected toner is measured with an electrometer 37 and the weight W of the collected toner is measured. The "electrification of the toner" is calculated as CT/W ($\mu$C/g).

When the surface of the element 6 has such triboelectric characteristics relative to the toner that the electrification of the toner is smaller than -40 $\mu$C/g when the toner on the image carrier 13 is negatively charged and greater than 40 $\mu$C/g when the toner on the image carrier 13 is positively charged, however, the amount of the charge of the toner particles 22 on the element 6 becomes so large, as a result of the frictional contact therebetween in the secondary image transfer step, that the coulomb force $F_2$ therebetween is greater than the coulomb force $F_1$ by the electrical field E applied between the image transfer medium 24 and the element 6. As a consequence, as shown in FIG. 2(*d*), part of the negatively charged toner particles 22 are not transferred to the medium 24 to form an untransferred portion 27, so that "worm-eaten" portion 28 is formed on the image transfer medium 24. Such a problem can be solved by increasing the intensity of the electrical field E. However, the use of a high electrical field E is disadvantageous not only because of increased costs but also because of a reduction of the image density.

The intermediate image transfer element 6 may be formed of a thermoplastic resin such as polyethylene, polystyrene, poly(vinyl chloride), polyester (e.g. polyethylene terephthalate), polyamide (e.g. nylon), polycarbonate, polyacrylonitrile, poly(vinyl fluoride), poly(vinylidene fluoride), an ethylene-tetrafluoroethylene copolymer, a vinylidene fluoride-tetrafluoroethylene copolymer, a vinylidene fluoride-tetrafluoroethylene-hexafluoropropylene terpolymer, polychloropolyfluoroethylene or polyimide. These resins may be used singly or in combination of two or more. If desired, the element 6 may be formed to have a multilayer structure. In this case, a thermosetting resin such as a silicone resin, a modified silicone resin, a fluoroethylene-vinyl ether copolymer, an epoxy resin, a phenol resin, a melamine resin, a urea resin or an alkyd resin may be used as a surface layer of the multilayer intermediate image transfer element.

An electrically conducting material is preferably incorporated into the intermediate image transfer element 6 to adjust the specific resistance thereof at $10^7$ to $10^{12}$ Ωcm. Illustrative of suitable conducting materials are polyethylene oxide, polyether amide, polyester ether amide, polyaniline, polypyrrole, alkanesulfonic acid metal salts, quaternary ammonium salts, ionic surfactants, carbon, graphite, tin oxide, zinc oxide, titanium black and metal powder.

If desired, a charge controlling agent may also incorporated into the element 6 to adjust the triboelectricity thereof. Examples of positively electrifying agents include quaternary ammonium salts, aminosilane, nigrosine dye, imidazole compounds, pyridine compounds and polyamides. Examples of negatively electrifying agents include fluorine resins, fluorine-containing compounds, metal salts of salicylic acid compounds.

The intermediate image transfer element 6 may be prepared by any known method such as by extrusion molding, injection molding, press molding, spray coating and dipping. The element 6 may be in any desired form such as an endless belt or a drum.

The toner employed in the present invention is known per se and is generally composed of a resin, a colorant and a charge controlling agent. Additives such as a fluidity-improving agent and a mold releasing agent may also be used, if desired. The resin may be, for example, a polyester resin, an epoxy resin, a phenol resin, a polyolefin resin or a styrene resin such as polystyrene, a styreneacrylic acid copolymer, a styrene-acrylate copolymer, a styrene-methacrylic acid copolymer, a styrene-methacrylate copolymer or a styrene-butadiene copolymer. The colorant may be a black, cyan, magenta or yellow dye. The charge controlling agent may be a positively electrifying agent such as a quaternary ammonium salt, a nigrosine dye, a basic dye or an amino acid-containing polymer, or a negatively electrifying agent such as chromium-containing monoazo dye, a chromium-containing organic dye or a metal salt of a salicylic acid compound. The fluidity-improving agent may be silica, titania or zinc stearate. The mold releasing agent may be a synthetic wax, an animal wax or a fat oil wax. The resin, colorant, charge controlling agent and mold releasing agent are melted, kneaded, solidified, ground, sieved and then mixed with the fluidity-improving agent to obtain toner.

The following examples will further illustrate the present invention. Parts are by weight.

EXAMPLE 1

Polyethylene terephthalate (100 parts) and carbon black (8 parts, Ketjenblack EC manufactured by Lion Akzo Co., Ltd.) were kneaded and extruded to form a seamless endless belt. A coating composition having the formulation shown below was applied on an outer surface of the belt by spray coating to obtain an intermediate charge transfer element (I) having an angle of contact with water of 80°.

| | |
|---|---|
| Fluorine resin (LUMIFLON 200 manufactured by Asahi Glass Inc.) | 100 parts (solid content) |
| Curing agent for LUMIFLON 200 (manufactured by Asahi Glass Inc.) | 20 parts |
| Carbon black (Printex 40 manufactured by Degusa Inc.) | 6 parts |
| Leveling agent (KF321 manufactured by Shin-etsu Chemical Inc.) | 1 part |
| Toluene | 200 parts |
| Xylene | 200 parts |

For the preparation of a negatively chargeable cyan toner, a mixture having the composition shown below was kneaded, solidified, ground and sieved to obtain a particulate material having a particle size of about 7 $\mu$m.

| | |
|---|---|
| Epoxy resin | 100 parts |
| Copper phthalocyanin | 1.5 part |
| Zinc salicylate | 1.5 part |

The particulate material (100 parts) thus obtained was mixed with hydrophobic silica (0.75 part) to obtain the cyan toner.

The electrification of the cyan toner relative to the intermediate charge transfer element (I) was measured using a device shown in FIG. 3. Further, the intermediate charge transfer element (I) was set in a color copier (PRETALE 550 manufactured by Ricoh Company, Ltd.) and copies were produced using the above cyan toner to check (a) degree of local omission of toner images (the formation of "worm-eaten" portions in the toner images) and (b) the image density. The degree of local omission was evaluated according to the following rating.

5 . . . No local omission

4 . . . Local omission, although almost invisible with the native eyes, is slightly observed 1 . . . A large number of local omission, although almost invisible with the native eyes, are formed 1 . . . A small number of local omission clearly visible with the native eyes are formed 1 . . . A large number of local omission clearly visible with the native eyes are formed The results are summarized in Table 1.

EXAMPLE 2

A coating composition having the formulation shown below was applied on an outer surface of the same endless belt as produced in Example 1 by spray coating to obtain an intermediate charge transfer element (II) having an angle of contact with water of 75°.

| | |
|---|---|
| Silicone resin (SR 2411 manufactured by Toray Dow Corning Silicone Inc.) | 100 parts (solid content) |
| Carbon black (Printex L manufactured by Degusa Inc.) | 5 parts |
| Leveling agent (KF321 manufactured by Shin-etsu Chemical Inc.) | 1 part |
| Toluene | 300 parts |

Using the same cyan toner as produced in Example 1, the electrification of the cyan toner relative to the intermediate charge transfer element (II) and the copy test were carried out in the same manner as that in Example 1. The results are shown in Table 1.

EXAMPLE 3

A coating composition having the formulation shown below was applied on an outer surface of the same endless belt as produced in Example 1 by spray coating to obtain an intermediate charge transfer element (III) having an angle of contact with water of 73°.

| | |
|---|---|
| Silicone resin (SR 2411 manufactured by Toray Dow Corning Silicone Inc.) | 100 parts (solid content) |
| Carbon black (Printex L manufactured by Degusa Inc.) | 5 parts |
| Leveling agent (KF321 manufactured by Shin-etsu Chemical Inc.) | 1 part |
| Aminosilane (SH 6020 manufactured by Toray Dow Corning Silicone Inc.) | 3 parts |
| Toluene | 300 parts |

Using the same cyan toner as produced in Example 1, the electrification of the cyan toner relative to the intermediate charge transfer element (III) and the copy test were carried out in the same manner as that in Example 1. The results are shown in Table 1.

EXAMPLE 4

Example 3 was repeated in the same manner as described except that the amount of the aminosilane was increased to 6 parts, thereby obtaining an intermediate charge transfer element (IV) having an angle of contact with water of 70°. Using the same cyan toner as produced in Example 1, the electrification of the cyan toner relative to the intermediate charge transfer element (IV) and the copy test were carried out in the same manner as that in Example 1. The results are shown in Table 1.

EXAMPLE 5

Example 3 was repeated in the same manner as described except that the amount of the aminosilane was increased to 10 parts, thereby obtaining an intermediate charge transfer element (V) having an angle of contact with water of 70°. Using the same cyan toner as produced in Example 1, the electrification of the cyan toner relative to the intermediate charge transfer element (V) and the copy test were carried out in the same manner as that in Example 1. The results are shown in Table 1.

COMPARATIVE EXAMPLE 1

An ethylene-tetrafluoroethylene copolymer (100 parts, tetrafluoroethylene content: 48 mol %) and black (8 parts)

were kneaded and extruded to form a seamless endless belt (Comp. I) having an angle of contact with water of 95°. Using the same cyan toner as produced in Example 1, the electrification of the cyan toner relative to the intermediate charge transfer element (Comp I) and the copy test were carried out in the same manner as that in Example 1. The results are shown in Table 1.

COMPARATIVE EXAMPLE 2

Poly(vinylidene fluoride) (100 parts, KF850 manufactured by Kureha Inc.) and carbon black (7 parts, Ketjenblack EC) were kneaded and extruded to form a seamless endless belt (Comp. II) having an angle of contact with water of 81°. Using the same cyan toner as produced in Example 1, the electrification of the cyan toner relative to the intermediate charge transfer element (Comp II) and the copy test were carried out in the same manner as that in Example 1. The results are shown in Table 1.

COMPARATIVE EXAMPLE 3

Polycarbonate (100 parts, bisphenol A-type) and carbon black (8 parts, Printex XE2 manufactured by Degusa Inc.) were kneaded and extruded to form a seamless endless belt (Comp. III) having an angle of contact with water of 45°. Using the same cyan toner as produced in Example 1, the electrification of the cyan toner relative to the intermediate charge transfer element (Comp III) and the copy test were carried out in the same manner as that in Example 1. The results are shown in Table 1.

TABLE 1

| Example No. | Element | Electrification (μC/g) | Contact Angle (degree) | Worm-Eaten Portion | Image Density |
|---|---|---|---|---|---|
| 1 | I | −20 | 80 | 5 | good |
| 2 | II | −22.5 | 75 | 5 | good |
| 3 | III | −32.5 | 73 | 5 | good |
| 4 | IV | −41.0 | 70 | 4 | good |
| 5 | V | −54.6 | 70 | 3 | fair |
| Comp. 1 | Comp I | +15.7 | 95 | 2 | good |
| Comp. 2 | Comp II | +26.2 | 81 | 1 | poor |
| Comp. 3 | Comp III | −22.6 | 45 | 1 | poor |

EXAMPLE 6

For the preparation of a positively chargeable cyan toner, a mixture having the composition shown below was kneaded, solidified, ground and sieved to obtain a particulate material having a particle size of about 7 μm.

| | |
|---|---|
| Polyester resin | 100 parts |
| Copper phthalocyanine | 1.5 part |
| Quaternary ammonium salt | 1.0 part |

The particulate material (100 parts) thus obtained was mixed with hydrophobic silica (0.75 part) to obtain the cyan toner. Using the intermediate charge transfer element (I) produced in Example 1, the electrification of the cyan toner relative to the element (I) and the copy test were carried out in the same manner as that in Example 1. The results are shown in Table 2.

EXAMPLE 7

Example 6 was repeated in the same manner as described except that the intermediate charge transfer element (II) was substituted for the element (I). The results are shown in Table 2.

EXAMPLE 8

Example 6 was repeated in the same manner as described except that the intermediate charge transfer element (III) was substituted for the element (I). The results are shown in Table 2.

COMPARATIVE EXAMPLE 4

Example 6 was repeated in the same manner as described except that the intermediate charge transfer element (IV) was substituted for the element (I). The results are shown in Table 2.

COMPARATIVE EXAMPLE 5

Example 6 was repeated in the same manner as described except that the intermediate charge transfer element (V) was substituted for the element (I). The results are shown in Table 2.

EXAMPLE 9

A coating composition having the formulation shown below was applied on an outer surface of the same endless belt as produced in Example 1 by spray coating to obtain an intermediate charge transfer element (VI) having an angle of contact with water of 90°.

| | |
|---|---|
| Fluorine resin (LUMIFLON 200 manufactured by Asahi Glass Inc.) | 100 parts (solid content) |
| Curing agent for LUMIFLON 200 (manufactured by Asahi Glass Inc.) | 20 parts |
| Carbon black (Printex 40 manufactured by Degusa Inc.) | 6 parts |
| Leveling agent (KP321 manufactured by Shin-etsu Chemical Inc.) | 1 part |
| Toluene | 200 parts |
| Xylene | 200 parts |
| Polytetrafluoroethylene powder (L-5 manufactured by Daikin Industries, Ltd. | 30 parts |

Example 6 was repeated in the same manner as described except that the intermediate charge transfer element (VI) was substituted for the element (I). The results are shown in Table 2.

TABLE 2

| Example No. | Element | Electrification (μC/g) | Contact Angle (degree) | Worm-Eaten Portion | Image Density |
|---|---|---|---|---|---|
| 6 | I | +18.2 | 80 | 5 | good |
| 7 | II | +12.1 | 75 | 5 | good |
| 8 | III | +7.7 | 73 | 5 | good |
| Comp. 4 | IV | −5.0 | 70 | 2 | good |
| Comp. 5 | V | −24.6 | 70 | 1 | fair |
| 9 | VI | +50.5 | 90 | 3 | good |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An image forming method wherein a toner image developed with dry tone on an image carrier is transferred in a first transfer step to an intermediate image transfer element, the transferred toner image on said intermediate image transfer element being subsequently transferred in a second transfer step to a transfer medium, characterized in that said intermediate image transfer element has a surface whose angle of contact with water is at least 70 degrees and whose position in the triboelectric series is on a positive side with respect to the position of said toner when said toner on said image carrier is negatively charged and on a negative side with respect to the position of said toner when said toner on said image carrier is positively charged.

2. An image forming method as claimed in claim 1, wherein the electrification of said toner relative to said surface is −40 to 0 $\mu$C/g when said toner on said image carrier is negatively charged and 0 to 40 $\mu$C/g when said toner on said image carrier is positively charged.

3. An image forming method as claimed in claim 1, wherein the contact angle with water of said surface is 80–120 degrees.

4. An image forming method as claimed in claim 1, wherein the electrification of said toner relative to said surface is −30 to 0 $\mu$C/g when said toner on said image carrier is negatively charged and 0 to 30 $\mu$C/g when said toner on said image carrier is positively charged.

5. The image forming method of claim 1, wherein said toner image developed with dry toner comprises particulate toner.

6. The image forming method of claim 1, wherein said second transferring step comprises electrically transferring said toner image.

7. An image forming method wherein a toner image developed with particulate toner on an image carrier is transferred in a first transfer step to an intermediate image transfer element, the transferred toner image on said intermediate image transfer element being subsequently transferred in a second transfer step to a transfer medium, characterized in that said intermediate image transfer element has a surface whose angle of contact with water is at least 70 degrees and whose position in the triboelectric series is on a positive side with respect to the position of said toner when said toner on said image carrier is negatively charged and on a negative side with respect to the position of said toner when said toner on said image carrier is positively charged.

8. An image forming method comprising the steps of developing with dry toner a toner image on an image carrier, transferring said toner image to an intermediate image transfer element, comprising, transferring said toner image to a surface of said intermediate image transfer element whose angle of contact with water is at least 70 degrees and whose position in the triboelectric series is on a positive side with respect to the position of said toner when said toner on said image carrier is negatively charged and on a negative side with respect to the position of said toner when said toner on said image carrier is positively charged; and transferring said toner image fr om s aid intermediate image transfer element to a transfer medium.

9. The method of claim 8, wherein said step of developing with dry toner comprises developing with a particulate toner.

10. The method of claim 8, wherein:

said step of transferring said toner image to an intermediate image transfer element, comprises transferring said toner image, when said image carrier is negatively charged, to said surface where an electrification of said toner relative to said surface is −40 to 0 $\mu$C/g; and said step of transferring said toner image to an intermediate image transfer element, comprises transferring said toner image, when said image carrier is positively charged, to said surface where an electrification of said toner relative to said surface is 0 to 40 $\mu$C/g.

11. The method of claim 8, wherein the contact angle with water of said surface is in an inclusive range of 80–120 degrees.

12. The method of claim 8, wherein:

said step of transferring said toner image to an intermediate image transfer element, comprises transferring said toner image, when said image carrier is negatively charged, to said surface where an electrification of said toner relative to said surface is −30 to 0 $\mu$C/g; and said step of transferring said toner image to an intermediate image transfer element, comprises transferring said toner image, when said image carrier is positively charged, to said surface where an electrification of said toner relative to said surface is 0 to 30 $\mu$C/g.

13. The method of claim 8, wherein said step of transferring said toner image from said intermediate image transfer element to a transfer medium comprises electrically transferring said toner image.

* * * * *

UNITED STATES PATENT AND TRADEMARK OFFICE

CERTIFICATE OF CORRECTION

PATENT NO. : 5,774,775

DATED : June 30, 1998

INVENTOR(S) : Jun Aoto et al

It is certified that error appears in the above-identified patent and that said Letters Patent is hereby corrected as shown below:

Column 4, line 43, after "also" insert --be--; and line 63, change "styreneacrylic" to --styrene-acrylate--.

Column 5, line 57, change "1" to --3--; and line 59, change "1" to --2--.

Column 8, line 38, after "Ltd." insert --)--.

Column 10, line 13, change "fr om s aid" to --from said--.

Signed and Sealed this

Thirteenth Day of July, 1999

*Attest:*

*Attesting Officer*

Q. TODD DICKINSON

*Acting Commissioner of Patents and Trademarks*